US009976425B2

(12) United States Patent
Weber et al.

(10) Patent No.: US 9,976,425 B2
(45) Date of Patent: May 22, 2018

(54) COOLING CIRCUIT FOR A MULTI-WALL BLADE

(71) Applicant: General Electric Company, Schenectady, NY (US)

(72) Inventors: David Wayne Weber, Simpsonville, SC (US); Mehmet Suleyman Ciray, Simpsonville, SC (US); Jacob Charles Perry, II, Taylors, SC (US)

(73) Assignee: General Electric Company, Schenectady, NY (US)

( * ) Notice: Subject to any disclaimer, the term of this patent is extended or adjusted under 35 U.S.C. 154(b) by 125 days.

(21) Appl. No.: 14/977,124

(22) Filed: Dec. 21, 2015

(65) Prior Publication Data

US 2017/0175542 A1 Jun. 22, 2017

(51) Int. Cl.
*F01D 5/18* (2006.01)
*F01D 5/14* (2006.01)

(52) U.S. Cl.
CPC ..... *F01D 5/187* (2013.01); *F01D 5/147* (2013.01); *F05D 2220/30* (2013.01); *F05D 2240/127* (2013.01); *F05D 2250/185* (2013.01); *F05D 2260/22141* (2013.01)

(58) Field of Classification Search
CPC ..... F01D 5/187; F01D 5/147; F05D 2220/30; F05D 2240/127; F05D 2250/185; F05D 2260/22141
See application file for complete search history.

(56) References Cited

U.S. PATENT DOCUMENTS

| | | | |
|---|---|---|---|
| 4,474,532 | A | 10/1984 | Pazder |
| 4,500,258 | A | 2/1985 | Dodd et al. |
| 4,753,575 | A | 6/1988 | Levengood et al. |
| 5,296,308 | A | 3/1994 | Caccavale et al. |
| 5,403,159 | A | 4/1995 | Green et al. |
| 5,813,835 | A | 9/1998 | Corsmeier et al. |
| 5,853,044 | A | 12/1998 | Wheaton et al. |
| 6,196,792 | B1 | 3/2001 | Lee et al. |
| 6,220,817 | B1 | 4/2001 | Durgin et al. |
| 6,264,428 | B1 | 7/2001 | Dailey et al. |

(Continued)

FOREIGN PATENT DOCUMENTS

| | | | |
|---|---|---|---|
| EP | 2 149 676 | A1 | 2/2010 |
| JP | H9-303103 | A | 11/1997 |
| JP | 2002242607 | A | 8/2002 |

OTHER PUBLICATIONS

Extended European Search Report and Opinion issued in connection with corresponding EP Application No. 16205162.7 dated May 4, 2017.

(Continued)

*Primary Examiner* — Richard Edgar
(74) *Attorney, Agent, or Firm* — Ernest G. Cusick; Hoffman Warnick LLC

(57) ABSTRACT

A turbine blade cooling system according to an embodiment includes: a first turn for redirecting a first flow of gas flowing through a first channel of a turbine blade into a central plenum of the turbine blade; and a second turn for redirecting a second flow of gas flowing through a second channel of the turbine blade into the central plenum; wherein the first turn is offset from the second turn to reduce impingement of the first flow of gas and the second flow of gas in the central plenum.

11 Claims, 6 Drawing Sheets

(56) References Cited

U.S. PATENT DOCUMENTS

| | | | | |
|---|---|---|---|---|
| 6,416,284 | B1 | 7/2002 | Demers et al. | |
| 6,478,535 | B1 | 11/2002 | Chung et al. | |
| 6,491,496 | B2 | 12/2002 | Starkweather | |
| 6,705,836 | B2 | 3/2004 | Bourriaud et al. | |
| 6,916,155 | B2 | 7/2005 | Eneau et al. | |
| 6,974,308 | B2 | 12/2005 | Halfmann et al. | |
| 7,217,097 | B2 * | 5/2007 | Liang | F01D 5/187 416/97 R |
| 7,303,376 | B2 | 12/2007 | Liang | |
| 7,527,475 | B1 | 5/2009 | Liang | |
| 7,607,891 | B2 | 10/2009 | Cherolis et al. | |
| 7,625,178 | B2 | 12/2009 | Morris et al. | |
| 7,686,581 | B2 | 3/2010 | Brittingham et al. | |
| 7,780,413 | B2 | 8/2010 | Liang | |
| 7,780,415 | B2 | 8/2010 | Liang | |
| 7,785,072 | B1 * | 8/2010 | Liang | F01D 5/187 416/97 R |
| 7,819,629 | B2 | 10/2010 | Liang | |
| 7,862,299 | B1 | 1/2011 | Liang | |
| 7,980,822 | B2 | 7/2011 | Cunha et al. | |
| 8,047,790 | B1 | 11/2011 | Liang | |
| 8,087,891 | B1 | 1/2012 | Liang | |
| 8,157,505 | B2 | 4/2012 | Liang | |
| 8,292,582 | B1 | 10/2012 | Liang | |
| 8,616,845 | B1 | 12/2013 | Liang | |
| 8,678,766 | B1 | 3/2014 | Liang | |
| 8,734,108 | B1 | 5/2014 | Liang | |
| 2008/0118366 | A1 | 5/2008 | Correia et al. | |
| 2012/0082566 | A1 | 4/2012 | Ellis et al. | |
| 2014/0096538 | A1 | 4/2014 | Boyer et al. | |
| 2014/0286790 | A1 | 9/2014 | Molter et al. | |
| 2015/0059355 | A1 | 3/2015 | Feigl et al. | |
| 2015/0184519 | A1 | 7/2015 | Foster et al. | |
| 2015/0184538 | A1 | 7/2015 | Smith | |
| 2016/0194965 | A1 | 7/2016 | Spangler | |
| 2016/0312632 | A1 * | 10/2016 | Hagan | F01D 9/041 |
| 2017/0173672 | A1 | 6/2017 | Foster et al. | |
| 2017/0175443 | A1 | 6/2017 | Pesticcio | |
| 2017/0175540 | A1 | 6/2017 | Weber et al. | |
| 2017/0175541 | A1 | 6/2017 | Weber et al. | |
| 2017/0175544 | A1 | 6/2017 | Smith et al. | |
| 2017/0175545 | A1 | 6/2017 | Foster et al. | |
| 2017/0175546 | A1 | 6/2017 | Smith et al. | |
| 2017/0175547 | A1 | 6/2017 | Smith et al. | |
| 2017/0175548 | A1 | 6/2017 | Smith et al. | |

OTHER PUBLICATIONS

U.S. Appl. No. 14/977,152, Office Action 1 dated Sep. 14, 2017, 15 pages.

U.S. Appl. No. 14/977,175, Office Action 1 dated Nov. 24, 2017, 25 pages.

U.S. Appl. No. 14/977,200, Office Action dated Dec. 19, 2017, 23 pages.

U.S. Appl. No. 14/977,152, Final Office Action 1 dated Dec. 26, 2017, 15 pages.

U.S. Appl. No. 14/977,228 Notice of Allowance dated Feb. 12, 2018, 34 pages.

U.S. Appl. No. 14/977,247, Notice of Allowance dated Feb. 12, 2018, 24 pages.

U.S. Appl. No. 14/977,270, Office Action dated Mar. 21, 2018, 42 pages.

* cited by examiner

COOLING CIRCUIT FOR A MULTI-WALL BLADE

CROSS-REFERENCE TO RELATED APPLICATIONS

This application is related to co-pending U.S. application Ser. Nos. 14/977,228, 14/977,102, 14/977,078, 14/977,152, 14/977,175, 14/977,200, 14/977,247, and 14/977,270, all filed on Dec. 21, 2015 and co-pending U.S. application Ser. Nos. 15/239,994, 15/239,968, 15/239,985, 15/239,940 and 15/239,930 all filed on Aug. 18, 2016.

BACKGROUND OF THE INVENTION

The disclosure relates generally to turbine systems, and more particularly, to reducing pressure loss in a multi-wall turbine blade cooling circuit.

Gas turbine systems are one example of turbomachines widely utilized in fields such as power generation. A conventional gas turbine system includes a compressor section, a combustor section, and a turbine section. During operation of the gas turbine system, various components in the system, such as turbine blades, are subjected to high temperature flows, which can cause the components to fail. Since higher temperature flows generally result in increased performance, efficiency, and power output of the gas turbine system, it is advantageous to cool the components that are subjected to high temperature flows to allow the gas turbine system to operate at increased temperatures.

Turbine blades of a gas turbine system typically contain an intricate maze of internal cooling channels. The cooling channels receive air from the compressor of the gas turbine system and pass the air through the internal cooling channels to cool the turbine blades. The teed pressure of the air passed through the cooling channels is generally at a premium, since the air is bled off of the compressor. To this extent, it is useful to provide cooling channels that reduce non-recoverable pressure loss; as pressure losses increase, a higher feed pressure is required to maintain an adequate gas-path pressure margin (back-flow margin). Higher feed pressures result in higher leakages in the secondary flow circuits (e.g., in rotors) and higher feed temperatures.

BRIEF DESCRIPTION OF THE INVENTION

A first aspect of the disclosure provides a turbine blade cooling system, including: a first turn for redirecting a first flow of gas flowing through a first channel of a turbine blade into a central plenum of the turbine blade; and a second turn for redirecting a second flow of gas flowing through a second channel of the turbine blade into the central plenum; wherein the first turn is offset from the second turn to reduce impingement of the first flow of gas and the second flow of gas in the central plenum.

A second aspect of the disclosure provides a turbine bucket, including: a shank; a blade coupled to the shank; and a cooling system, the cooling system including: a first turn for redirecting a first flow of gas flowing through a first channel of the blade into a central plenum of the blade; a second turn for redirecting a second flow of gas flowing through a second channel of the blade into the central plenum of the blade; wherein the first turn is offset from the second turn to reduce impingement of the first flow of gas and the second flow of gas in the central plenum of the blade, the reduced impingement decreasing pressure loss in the central plenum of the blade.

A third aspect of the disclosure provides a turbine bucket, comprising: a shank; a multi-wall blade coupled to the shank; and a cooling system, the cooling system including: a first turn for redirecting a first flow of gas flowing through a first channel into a central plenum of the blade; a second turn for redirecting a second flow of gas flowing through a second channel into the central plenum of the blade, the first flow of gas and the second flow of gas combining in the central plenum; wherein the first turn is angularly offset from the second turn to reduce impingement of the first flow of gas and the second flow of gas in the central plenum of the blade, the reduced impingement decreasing pressure loss in the central plenum.

The illustrative aspects of the present disclosure solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawing that depicts various embodiments of the disclosure.

It is noted that the drawing of the disclosure is not to scale. The drawing is intended to depict only typical aspects of the disclosure, and therefore should not be considered as limiting the scope of the disclosure. In the drawing, like numbering represents like elements between the drawings.

DETAILED DESCRIPTION OF THE INVENTION

As indicated above, the disclosure relates generally to turbine systems, and more particularly, to reducing pressure loss in a multi-wall turbine blade cooling circuit.

Figure 1:
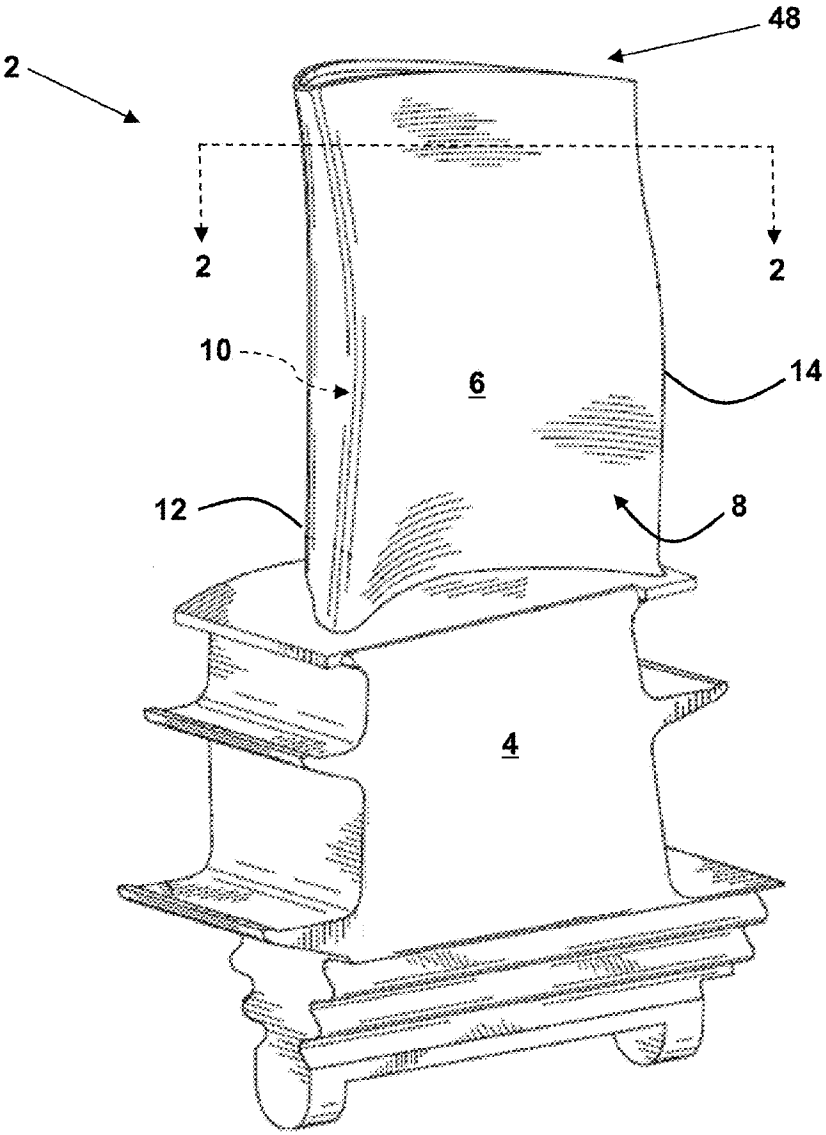
FIG. 1 shows a perspective view of a turbine bucket including a blade, according to embodiments.

Turning to FIG. 1, a perspective view of a turbine bucket 2 is shown. The turbine bucket 2 includes a shank 4 and a blade 6 (e.g., a multi-wall blade) coupled to and extending radially outward from the shank 4. The blade 6 includes a pressure side 8 and an opposed suction side 10. The blade 6 further includes a leading edge 12 between the pressure side 8 and the suction side 10, as well as a trailing edge 14 between the pressure side 8 and the suction side 10 on a side opposing the leading edge 12.

The shank 4 and blade 6 may each be formed of one or more metals (e.g., steel, alloys of steel, etc.) and can be formed (e.g., cast, forged or otherwise machined) according to conventional approaches. The shank 4 and blade 6 may be integrally formed (e.g., cast, forged, three-dimensionally printed, etc.), or may be formed as separate components which are subsequently joined (e.g., via welding, brazing, bonding or other coupling mechanism).

Figure 2:
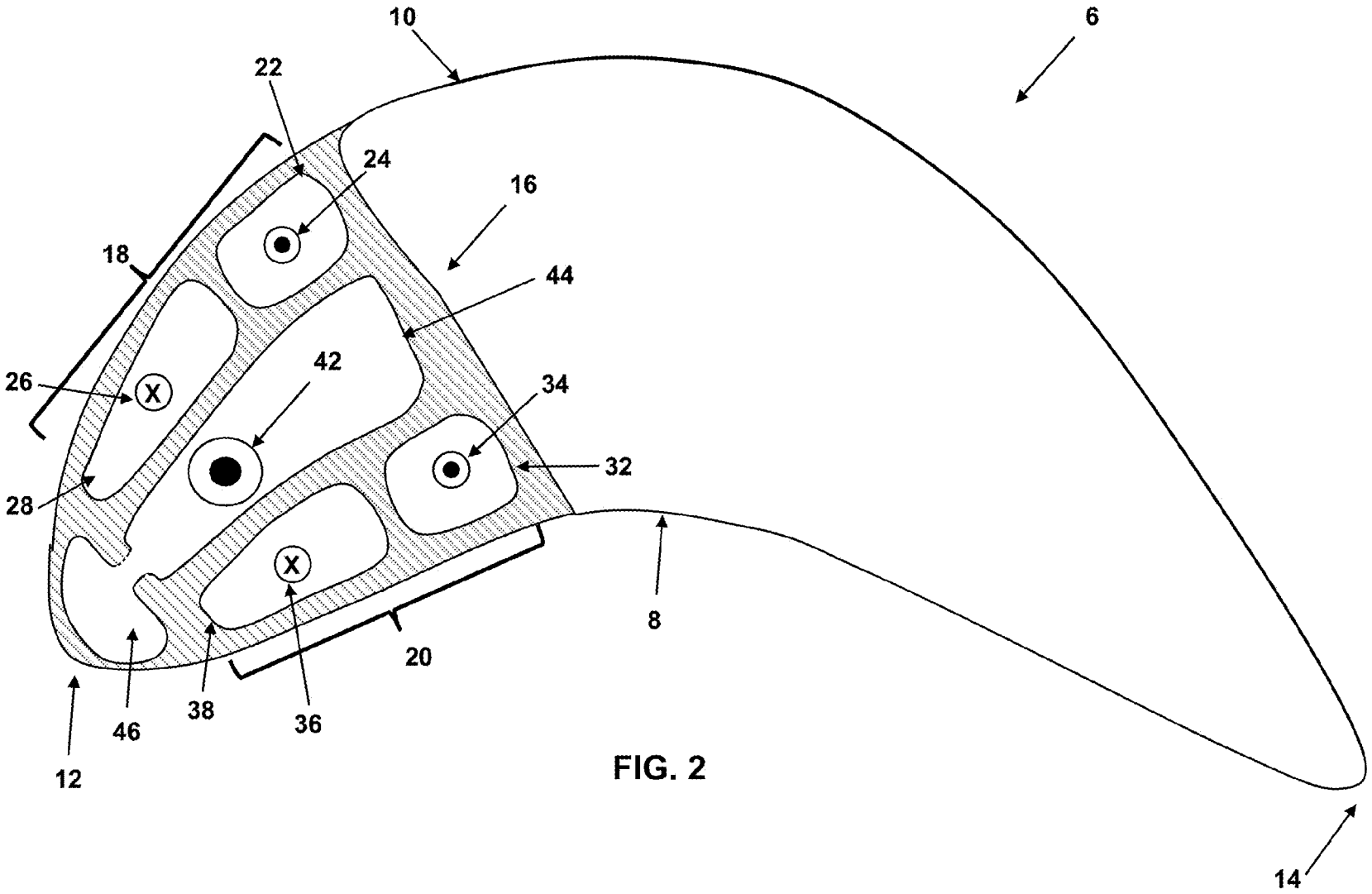
FIG. 2 is a partial cross-sectional view of the blade of FIG. 1, taken along line 2-2 in FIG. 1, according to embodiments.

FIG. 2 is a partial cross-sectional view of the blade 6 taken along ling 2-2 of FIG. 1, depicting a cooling arrangement 16 including a plurality of cooling circuits, according to embodiments. In this example, the cooling arrangement 16 includes an internal 2-pass serpentine suction side (SS) cooling circuit 18 on the suction side 10 of the blade 6 as well as an internal 2-pass serpentine pressure side (PS) cooling circuit 20 on the pressure side 8 of the blade 6. Although described in terms of a 2-pass serpentine cooling circuit, it should be apparent to those skilled in the art that the pressure loss reducing structures of the present disclosure (described below) may be used in conjunction with other types of serpentine (e.g., 3-pass, 4-pass, etc.) and/or non-serpentine cooling circuits in which "spent" cooling air from a plurality of flow channels is collected for redistribution to other areas of the blade 6, shank 4, and/or other portions of the bucket 2 for cooling purposes. Further, the pressure loss reducing structures may be used in other sections of the blade 6, shank 4, and/or other portions of the bucket 2 where there is a need for gathering a plurality of gas flows into a single gas flow for redistribution.

The SS cooling circuit 18 includes a feed channel 22 for directing a flow of cooling gas 24 (e.g., air) radially outward toward a tip area 48 (FIG. 1) of the blade 6 along the suction side 10 of the blade 6. In FIG. 2, the flow of cooling gas 24 is depicted as flowing out of the page. After passing through a turn (not shown), a flow of "spent" cooling gas 26 is directed back towards the shank 4 of the blade 6 through a return channel 28. In FIG. 2, the flow of cooling gas 26 is depicted as flowing into the page.

The PS cooling circuit 20 includes a feed channel 32 for directing a flow of cooling gas 34 (e.g., air) radially outward toward the tip area 48 (FIG. 1) of the blade 6 along the pressure side 8 of the blade 6. After passing through a turn (not shown), a flow of "spent" cooling gas 36 is directed back towards the shank 4 of the blade 6 through a return channel 38. In FIG. 2, the flow of cooling gas 34 is depicted as flowing out of the page, while the flow of cooling gas 36 is depicted as flowing into the page.

Figure 3:
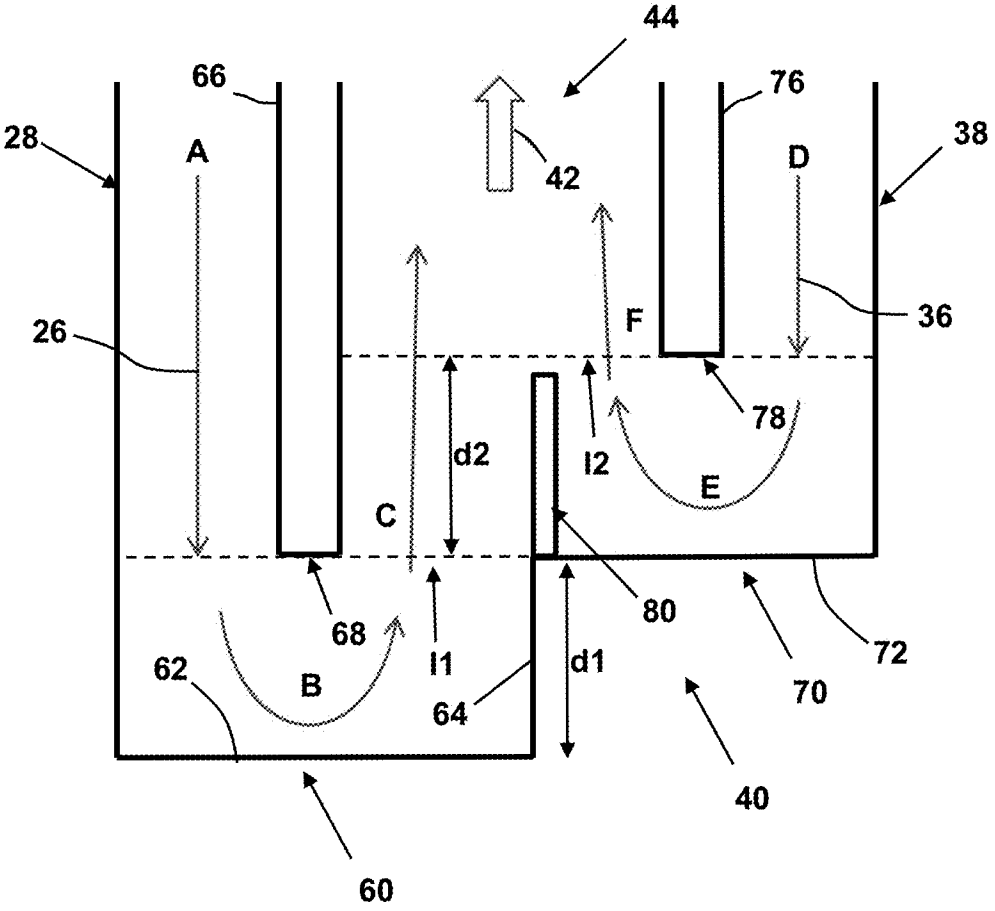
FIG. 3 depicts a pressure loss reducing structure with opposing feeds, according to embodiments.
Figure 5:
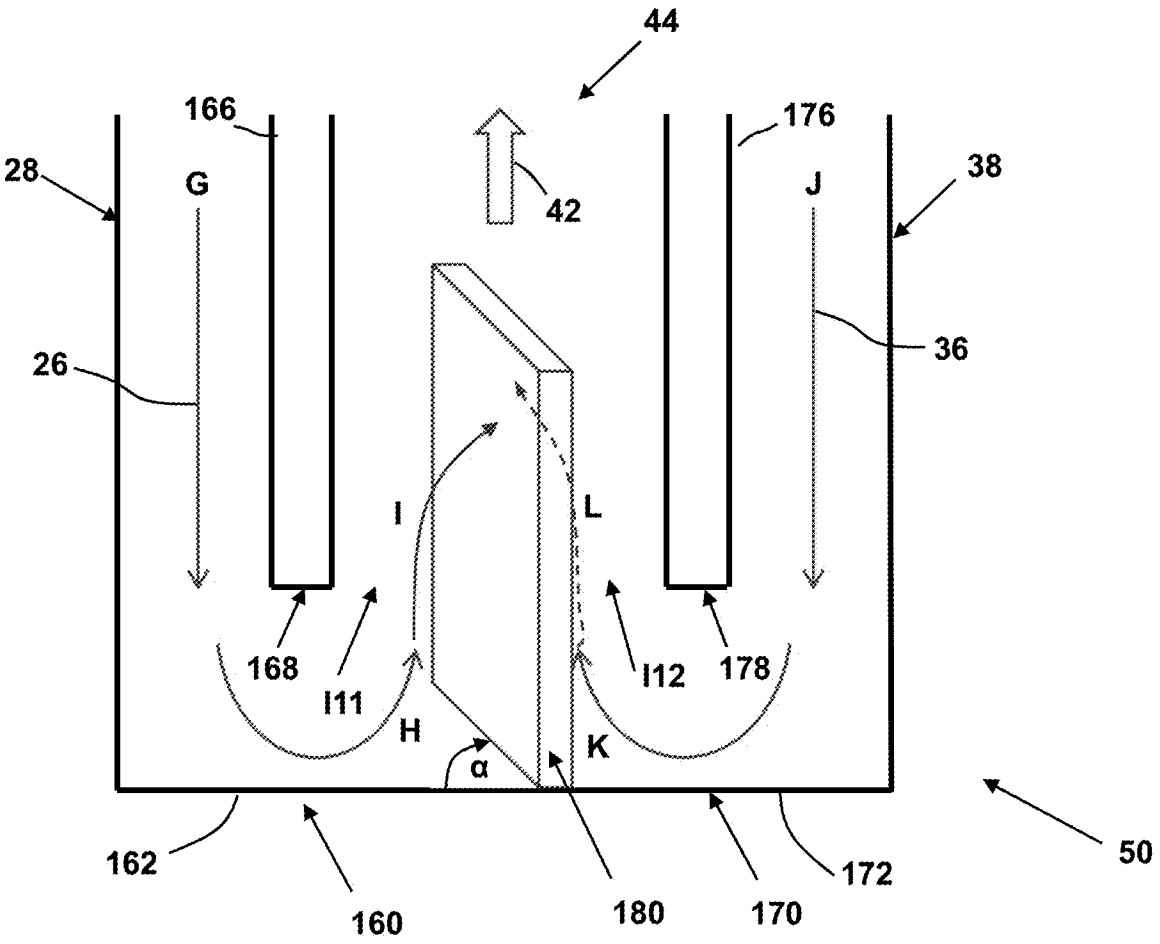
FIG. 5 depicts a pressure loss reducing structure with angled feeds, according to embodiments.

According to embodiments, referring to FIGS. 3 and 5, together with FIG. 2, a pressure loss reducing structure 40 (FIG. 3), 50 (FIG. 5) is provided for combining the flow of cooling gas 26 flowing through the return channel 28 of the SS cooling circuit 18 with the flow of cooling gas 36 flowing through the return channel 38 of the PS cooling circuit 20, to form a single, combined flow of cooling gas 42 within a central plenum 44. Advantageously, this is achieved with reduced pressure loss by preventing impingement of the flows of cooling gas 26, 36 as the flows enter the central plenum 44. The pressure loss reducing structure 40, 50 is configured to offset the flows of cooling gas 26, 36 either positionally (FIG. 3) or angularly (FIG. 5) such that the flows of cooling gas 26, 36 do not impinge on one another in the center plenum 44.

In the blade 6, the flow of cooling gas 42 passes radially outward through the central plenum 44 (out of the page in FIG. 2). From the center plenum 44, the flow of cooling gas 42 may be redistributed, for example, to a leading edge cavity 46 (FIG. 1) located in the leading edge 12 of the blade 6 to provide impingement cooling. Alternatively, or in addition, the flow of cooling gas 42 may be redistributed to a tip area 48 (FIG. 1) of the blade 6. The flow of cooling gas 42 may also be provided to other locations within the blade 6, shank 4, and/or other portions of the bucket 2 to provide convention cooling. Still further, the flow of cooling gas 42 may be used to provide film cooling of the exterior surfaces of the blade 6. Depending on the location of the pressure loss reducing structure 40, 50 in the blade 6, the flow of cooling gas 42 may be also be redistributed, for example, to cooling channels/circuits at the trailing edge 14 of the blade 6. Any number of pressure loss reducing structures 40, 50 may be employed within the blade 6.

A first embodiment of a pressure loss reducing structure 40 including opposing feeds is depicted in FIG. 3. As shown in FIG. 3, the flow of cooling gas 26 flowing through the return channel 28 of the SS cooling circuit 18 flows through the return channel 28 in a first direction (arrow A) to a first turn 60 of the pressure loss reducing structure 40. At the first turn 60, the flow of cooling gas 26 is redirected (arrow B) by an end wall 62 and side wall 64 of the first turn 60. The redirected flow of cooling gas 26 subsequently flows toward and into (arrow C) the center plenum 44, forming a portion of the flow of cooling gas 42. The return channel 28 and the center plenum 44 are separated by a rib 66. As shown in FIG. 3, the flow of cooling gas 26 flows around an end section 68 of the rib 66.

Also depicted in FIG. 3 is a second turn 70 of the pressure loss reducing structure 40. The flow of cooling gas 36 flowing through the return channel 38 of the PS cooling circuit 20 flows through the return channel 38 in a first direction (arrow D) to the second turn 70 of the pressure loss reducing structure 40. At the second turn 70, the flow of cooling gas 36 is redirected (arrow E) by an end wall 72 of the second turn 70. The redirected flow of cooling gas 36 subsequently flows toward and into (arrow F) the center plenum 44, forming another portion of the flow of cooling gas 42. The return channel 38 and the center plenum 44 are separated by a rib 76. The flow of cooling gas 36 flows around an end section 78 of the rib 76.

As shown in FIG. 3, the end walls 62, 72 of the first and second turns 60, 70 are positionally offset (e.g., radially along a length of the blade 6) from one another by a distance d1. According to embodiments, D1 may be greater than or equal to a height of the first turn 60. Further, the end sections 68, 78 of the ribs 66, 76, as well as the inlets I1, I2 into the central plenum 44, are positionally (e.g., vertically) offset from one another by a distance d2. Depending on the specific implementation of the pressure loss reducing structure 40, d1 and d2 may be substantially equal. In addition, the end section 68 of rib 66 may be coplanar with the end wall 72 of the second turn 70. A rib 80 may be positioned between the first and second turns 60, 70 to help guide and align the redirected flows of cooling gas 26, 36 as the flows enter the center plenum 44. Advantageously, the redirected flows of cooling gas 26, 36 flow into the center plenum 44 with reduced impingement and reduced associated pressure loss.

Figure 4:
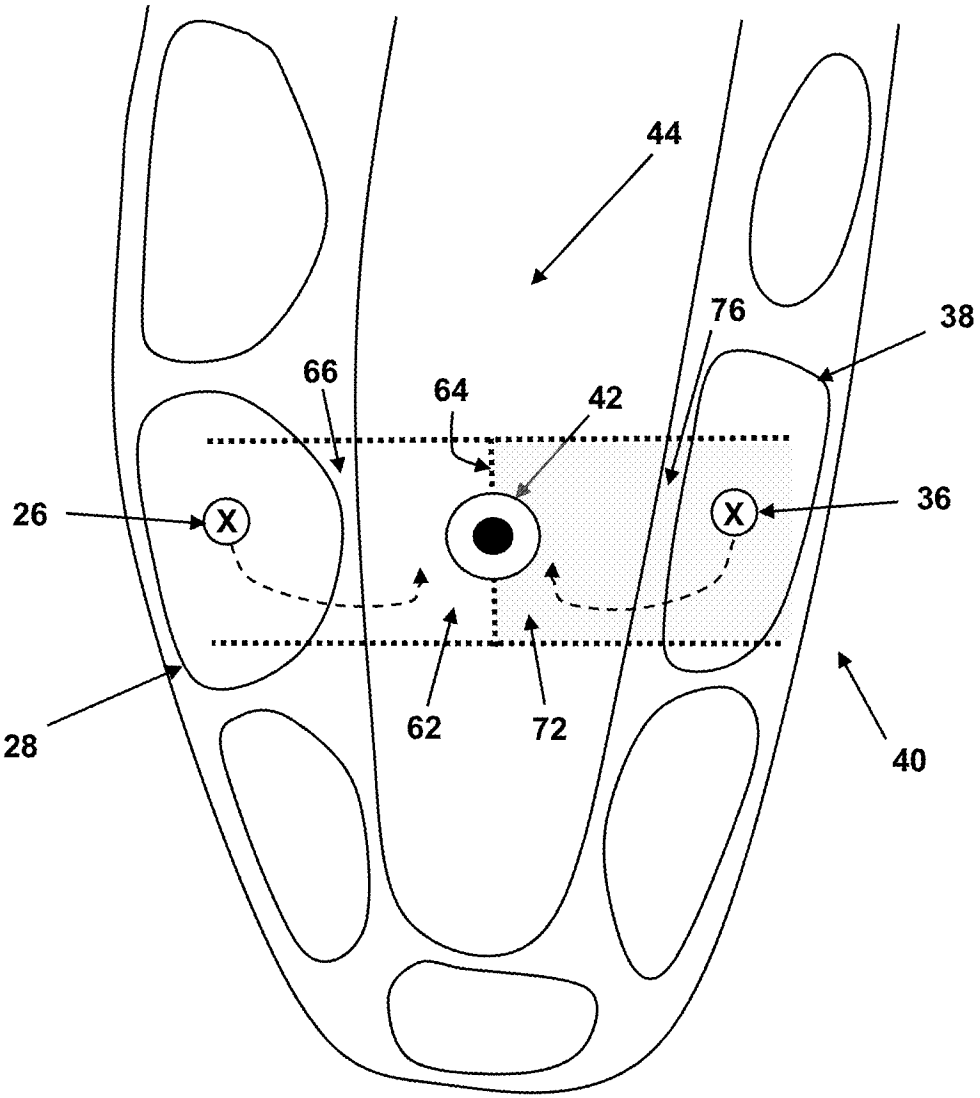
FIG. 4 is a partial cross-sectional view of the blade of FIG. 1 depicting a pressure loss reducing structure with opposing feeds, according to embodiments.

FIG. 4 is a partial cross-sectional view of the blade of FIG. 1 depicting the pressure loss reducing structure 40. As shown, the flow of cooling gas 26 flows through the return channel 28 in a first direction (into the page in FIG. 4) to a first turn 60 (FIG. 3) of the pressure loss reducing structure 40. At the first turn 60, the flow of cooling gas 26 is redirected by the end wall 62 and side wall 64 (FIG. 3) of the first turn 60. The redirected flow of cooling gas 26 subsequently flows in a second direction (out of the page in FIG. 4) into the center plenum 44, forming a portion of the flow of cooling gas 42. The return channel 28 and the center plenum 44 are separated by the rib 66.

The flow of cooling gas 36 flows through the return channel 38 in a first direction (into the page in FIG. 4) to the second turn 70 (FIG. 3) of the pressure loss reducing structure 40. At the second turn 70, the flow of cooling gas 36 is redirected by an end wall 72 of the second turn 70. The redirected flow of cooling gas 36 subsequently flows in a second direction (out of the page in FIG. 4) into the center plenum 44, forming another portion of the flow of cooling gas 42. The return channel 38 and the center plenum 44 are separated by the rib 76. The end walls 62, 72 of the first and second turns 60, 70 are positionally (e.g., vertically) offset from one another.

Figure 6:
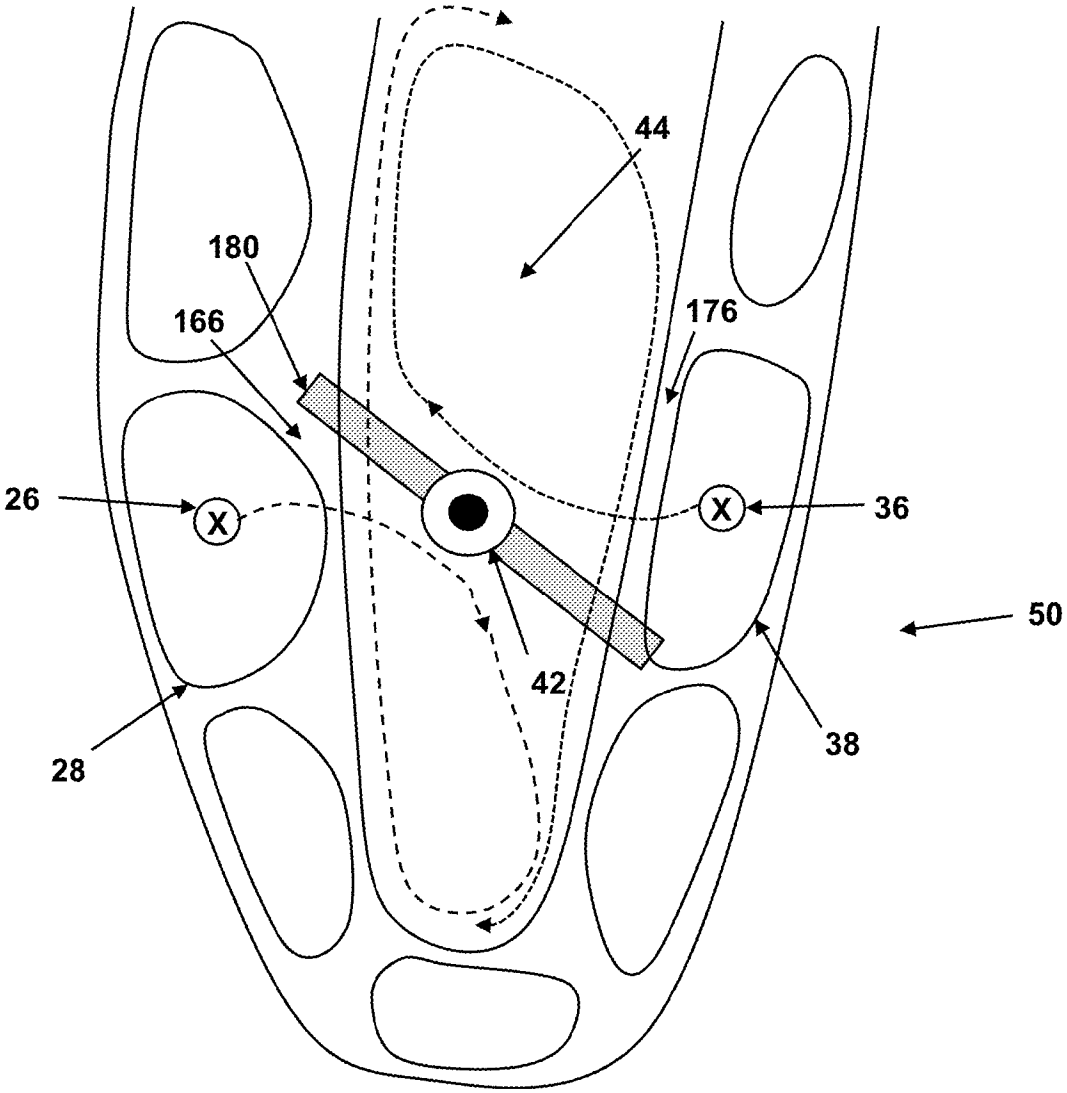
FIG. 6 is a partial cross-sectional view of the blade of FIG. 1 depicting a pressure loss reducing structure with angled feeds, according to embodiments.

An embodiment of a pressure loss reducing structure 50 including angled feeds is depicted in FIG. 5 together with FIG. 6. As shown, the flow of cooling gas 26 flows through the return channel 28 in a first direction (arrow G) to the first turn 160 of the pressure loss reducing structure 50. At the first turn 160, the flow of cooling gas 26 is redirected (arrow H) by an end wall 162 of the first turn 160 and a rib 180. The redirected flow of cooling gas 26 flows (arrow I) in a swirling manner toward and into the center plenum 44, forming a portion of the flow of cooling gas 42. The return channel 28 and the center plenum 44 are separated by a rib 166. The flow of cooling gas 26 flows around an end section 168 of the rib 166.

Also depicted in FIG. 5 together with FIG. 6 is the second turn 170 of the pressure loss reducing structure 50. The flow of cooling gas 36 flows through the return channel 38 in a first direction (arrow J) to the second turn 170 of the pressure loss reducing structure 50. At the second turn 170, the flow of cooling gas 36 is redirected (arrow K) by an end wall 172 of the second turn 70 and the rib 180. The redirected flow of cooling gas 36 subsequently flows (arrow L) in a swirling manner toward and into the center plenum 44, forming another portion of the flow of cooling gas 42. The swirling also acts to reduce pressure losses as the flows of cooling gas 26, 36 combine to form the flow of cooling gas 42. The return channel 38 and the center plenum 44 are separated by a rib 176. The flow of cooling gas 36 flows around an end section 178 of the rib 176.

Unlike the pressure loss reducing structure 40 shown in FIG. 3, the end walls 162, 172 of the first and second turns 160, 170 illustrated in FIG. 5 are not positionally (e.g., vertically) offset from one another in the pressure loss reducing structure 50. Rather, the end walls 162, 172 of first and second turns 160, 170 are substantially coplanar. In this embodiment, the rib 180 and the inlets I11 and I12 into the central plenum 44 are configured to angle and swirl the flows of cooling gas 26, 36 away from each other (e.g., in different directions), reducing flow impingement and reducing associated pressure loss. In embodiments, as depicted in FIG. 5, the rib 180 may disposed at an angle $\alpha$ of sufficient to offset the opposing flows of cooling gas 26, 36. The flows of cooling gas 26, 36 pass into and through the central plenum 44 and combine to form the flow of cooling gas 42.

By preventing impingement of the flows of cooling gas 26, 36 as the flows enter the central plenum 44, pressure loss is reduced when using the pressure loss reducing structure 40, 50. Thus, a lower feed pressure is required to maintain an adequate gas-path pressure margin (back-flow margin). Further, lower feed pressures result in lower leakages in the secondary flow circuits (e.g., in rotors) and lower feed temperatures.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element, it may be directly on, engaged, connected or coupled to the other element, or intervening elements may be present. In contrast, when an element is referred to as being "directly on," "directly engaged to", "directly connected to" or "directly coupled to" another element, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine blade cooling system, comprising:

a first turn for redirecting a first flow of gas flowing through a first channel of a turbine blade into a central plenum of the turbine blade; and a second turn for redirecting a second flow of gas flowing through a second channel of the turbine blade into the central plenum;

wherein the first turn is offset from the second turn to reduce impingement of the first flow of gas and the second flow of gas in the central plenum, wherein the first turn includes an end wall and the second turn includes an end wall, and wherein there is a positional offset between the end wall of the first turn and the end wall of the second turn, and wherein the first turn further includes a side wall having a length equal to the positional offset.

2. The turbine blade cooling system according to claim 1, wherein the turbine blade comprises a multi-wall turbine blade.

3. The turbine blade cooling system according to claim 1, wherein the reduced impingement decreases pressure loss in the central plenum.

4. The turbine blade cooling system according to claim 1, further comprising a rib disposed between the first turn and the second turn.

5. The turbine blade cooling system according to claim 1, wherein the first channel extends along a suction side of the blade, and wherein the second channel extends along a pressure side of the blade.

6. A turbine bucket, comprising:

a shank;

a blade coupled to the shank; and a cooling system, the cooling system including:

a first turn for redirecting a first flow of gas flowing through a first channel of the blade into a central plenum of the blade;

a second turn for redirecting a second flow of gas flowing through a second channel of the blade into the central plenum of the blade;

wherein the first turn is offset from the second turn to reduce impingement of the first flow of gas and the second flow of gas in the central plenum of the blade, the reduced impingement decreasing pressure loss in the central plenum of the blade, and wherein the first turn includes an end wall and a side wall, wherein the second turn includes an end wall, and wherein the end wall of the first turn is positionally offset from the end wall of the second turn by a distance equal to a length of the side wall of the first turn.

7. The turbine bucket according to claim 6, wherein the turbine blade comprises a multi-wall turbine blade.

8. The turbine bucket according to claim 6, wherein the first channel extends along a suction side of the blade, and wherein the second channel extends along a pressure side of the blade.

9. A turbine bucket, comprising:

a shank;

a multi-wall blade coupled to the shank; and a cooling system, the cooling system including:

a first turn for redirecting a first flow of gas flowing through a first channel into a central plenum of the blade;

a second turn for redirecting a second flow of gas flowing through a second channel into the central plenum of the blade, the first flow of gas and the second flow of gas combining in the central plenum;

wherein the first turn is angularly offset from the second turn to reduce impingement of the first flow of gas and the second flow of gas in the central plenum of the blade, the reduced impingement decreasing pressure loss in the central plenum, and wherein the turbine blade further includes a rib disposed between the first turn and the second turn, wherein the rib directs the first flow of gas in a first direction into the central plenum, and wherein the rib directs the second flow of gas in a second, different direction into the central plenum.

10. The turbine bucket according to claim 9, wherein the first turn includes an end wall and the second turn including an end wall, and wherein the end wall of the first turn is substantially coplanar with the end wall of the second turn.

11. The turbine bucket according to claim 9, wherein the combined flow of gas in the central plenum is provided by the cooling system to other areas of the blade or shank for cooling.

* * * * *